US010366560B2

(12) United States Patent
Weber et al.

(10) Patent No.: US 10,366,560 B2
(45) Date of Patent: Jul. 30, 2019

(54) TOUCHLESS LID DISPENSER APPARATUS AND METHOD

(71) Applicant: Dan & O'B Enterprises, LLC, Alexandria, MN (US)

(72) Inventors: Daniel J. Weber, Alexandria, MN (US); John Joseph Jancsek, Minneapolis, MN (US); Mark Thomas Podvin, Fridley, MN (US); Matthew Lawrence Stoffel, Maplewood, MN (US)

(73) Assignee: Dan & O'B Enterprises, LLC, Alexandria, MN (US)

( * ) Notice: Subject to any disclaimer, the term of this patent is extended or adjusted under 35 U.S.C. 154(b) by 0 days.

(21) Appl. No.: 14/802,736

(22) Filed: Jul. 17, 2015

(65) Prior Publication Data

US 2016/0113414 A1 Apr. 28, 2016

Related U.S. Application Data

(60) Provisional application No. 62/025,896, filed on Jul. 17, 2014.

(51) Int. Cl.

| | |
|---|---|
| ***A47F 1/08*** | (2006.01) |
| ***G07F 11/16*** | (2006.01) |
| ***G07F 9/02*** | (2006.01) |

(52) U.S. Cl.

CPC ..... *G07F 9/026* (2013.01); *A47F 1/082* (2013.01); *A47F 1/085* (2013.01); *G07F 11/16* (2013.01)

(58) Field of Classification Search

CPC . A47F 1/08; A47F 1/085; G07F 11/16; G07F 11/26; G07F 9/026

See application file for complete search history.

(56) References Cited

U.S. PATENT DOCUMENTS

| | | | | |
|---|---|---|---|---|
| 3,581,937 A * | 6/1971 | Johnson | ..... | B65G 59/107 221/259 |
| 4,133,525 A * | 1/1979 | Balles | ..... | A63F 9/24 221/209 |
| 4,319,441 A * | 3/1982 | Credle | ..... | G07F 13/10 53/131.2 |

(Continued)

FOREIGN PATENT DOCUMENTS

| | | |
|---|---|---|
| WO | 2007030867 A1 | 3/2007 |
| WO | 2010025512 A1 | 3/2010 |
| WO | 2013116203 A1 | 8/2013 |

OTHER PUBLICATIONS

Flexroller, EZLid—Lid Dispenser, Retrieved from http://www.ezlid.com/features/, 2013, 4 pages.

(Continued)

*Primary Examiner* — Gene O Crawford
*Assistant Examiner* — Kelvin L Randall, Jr.
(74) *Attorney, Agent, or Firm* — Billion & Armitage; Richard E. Billion

(57) ABSTRACT

A lid dispensing system includes a housing, a sensor, and a dispenser. The sensor senses objects outside the housing. Once sensed, a dispenser within the housing coveys a lid outside the housing. A method for dispensing lids is also disclosed. The method includes sensing objects outside a housing, separating a lid from a stack of lids, and conveying lids to a position outside the housing.

15 Claims, 18 Drawing Sheets

(56) References Cited

U.S. PATENT DOCUMENTS

| | | | | |
|---|---|---|---|---|
| 4,436,222 | A * | 3/1984 | Taylor | B65G 59/101 221/223 |
| 4,949,526 | A * | 8/1990 | Brogna | B65B 7/2807 221/104 |
| 5,038,969 | A * | 8/1991 | Berger | G07F 13/10 221/191 |
| 5,131,562 | A * | 7/1992 | Brown | A47F 1/106 221/193 |
| 6,474,503 | B2 * | 11/2002 | Davis | G07F 13/10 221/223 |
| 6,659,305 | B2 * | 12/2003 | Thompson | A47F 1/04 221/223 |
| 6,786,359 | B1 | 9/2004 | Schroeder | |
| 7,422,127 | B2 * | 9/2008 | Christoffersen | A47F 1/106 221/191 |
| 7,487,886 | B2 | 2/2009 | Hecht | |
| 7,900,797 | B1 | 3/2011 | Witcraft | |
| 8,025,181 | B1 * | 9/2011 | Horn | G07F 13/10 221/123 |
| 8,297,473 | B2 | 10/2012 | Smith | |
| 9,049,949 | B1 * | 6/2015 | Taylor | A47F 1/085 |
| 2001/0038017 | A1 * | 11/2001 | Davis | G07F 13/10 221/188 |
| 2006/0157493 | A1 * | 7/2006 | Christoffersen | A47F 1/106 221/36 |
| 2007/0131705 | A1 * | 6/2007 | Behravesh | A47G 21/12 221/130 |
| 2008/0302817 | A1 | 12/2008 | Arndt | |
| 2011/0101017 | A1 * | 5/2011 | Schroeder | B65G 59/108 221/1 |
| 2011/0210137 | A1 * | 9/2011 | Kling | A47K 10/36 221/6 |

OTHER PUBLICATIONS

Georgia-Pacific, SmartStock Touchless Executive Series Fork Dispenser, Retrieved from http://www.gppro.com, 2013, 1 page.

Steri-Straw, Touchless Straw Dispenser, Retrieved from http://www.steri-straw.com, 2014, 1 page.

Taylortack, LLC, Push n Go Single Lid Dispenser, Retrieved from http://taylortack.com/instructions.htm, 2011, 1 page.

The Vollrath Company, LLC, LidSaver Single Lid Dispenser Delivers Savings, Convenience, and Improved Hygiene, Retrieved from vollrath.com/Vollrath-Files/Price-Lists/Brochure-LidSaver-US-2013.pdf, 2013, 4 pages.

* cited by examiner

TOUCHLESS LID DISPENSER APPARATUS AND METHOD

RELATED APPLICATIONS

This application claims the benefit under 35 U.S.C. § 119(e) of U.S. Provisional Patent Application No. 62/025,896 filed Jul. 17, 2014, which is incorporated herein by reference. A claim of priority is made.

FIELD OF THE INVENTION

The present inventions relates to a touchless lid dispenser apparatus and method. In addition, the present inventions include methods for manufacturing, installing and using the touchless lid dispenser apparatus and method.

BACKGROUND

Many retail outlets serve drinks of all sorts in disposable cups. Fast food restaurants, convenience stores, and the like all provide millions of drinks in disposable cups on a daily basis. Hot drinks such as coffee, hot chocolate, tea and the like are placed in disposable, insulated cups. Cold drinks are commonly placed in plastic or another disposable container. Disposable lids and sized to fit the disposable cups. The disposable lids can be placed on the cup by a restaurant employee. This is commonplace, for example, in a drive-through or drive-up restaurant. The lid prevents spills when a drink is passed to the consumer in an automobile, truck or other mode of transportation. The lid also prevents spills when the vehicle is underway. In some fast food restaurants, the consumer is given the choice of dining in or taking the meal from the restaurant. Even though some are dining in they are provided with the option of getting and placing a lid on a disposable cup. They may have small children or may be cautious.

In any event, the restaurant employee or consumer usually obtains the lid and places it on a disposable cup. In some beverage dispensing situations, beverage cup lids are dispensed to customers in a vertical stack or in elongated horizontal trays. When cup lids are tendered in a vertical stack, customers must grab a lid from the top of the stack. Customers of varying heights are not all able to conveniently reach the top of the stack. Because the lids are nested and held together via frictional fit, they will often stick together so that a customer will pick up more than one lid. The excess lids are normally put back on the stack, dropped on the counter, or thrown into the trash. When cup lids are presented in a tray or hopper, two hands are often needed by a customer to separate the nested lids. Additionally, such lids frequently become disordered and are often handled by more than one customer, thus resulting in increased risk of unsanitary conditions. People's hands include germs. Therefore, by touching the stack of lids, the germs on each person's hands are transferred to the stack. Even people that wash their hands regularly will have germs on their hands. Germs that could possibly spread infection are placed on the stack of lids via touch. The more times the stack is touched or handled, the greater the likelihood of spreading an infection.

When a dispenser is placed behind the counter where only employees are able to dispense lids, the dispenser is much less likely to be contaminated. The employees are required to wash their hands. Customers are not required to wash their hands. As a result, when the dispenser is placed in a public portion of a restaurant for customers to use on a self-service fashion, the likelihood of contamination increases dramatically since the lids are subjected to more people, some of which may not wash their hands.

DESCRIPTION OF THE INVENTION

Figure 1:
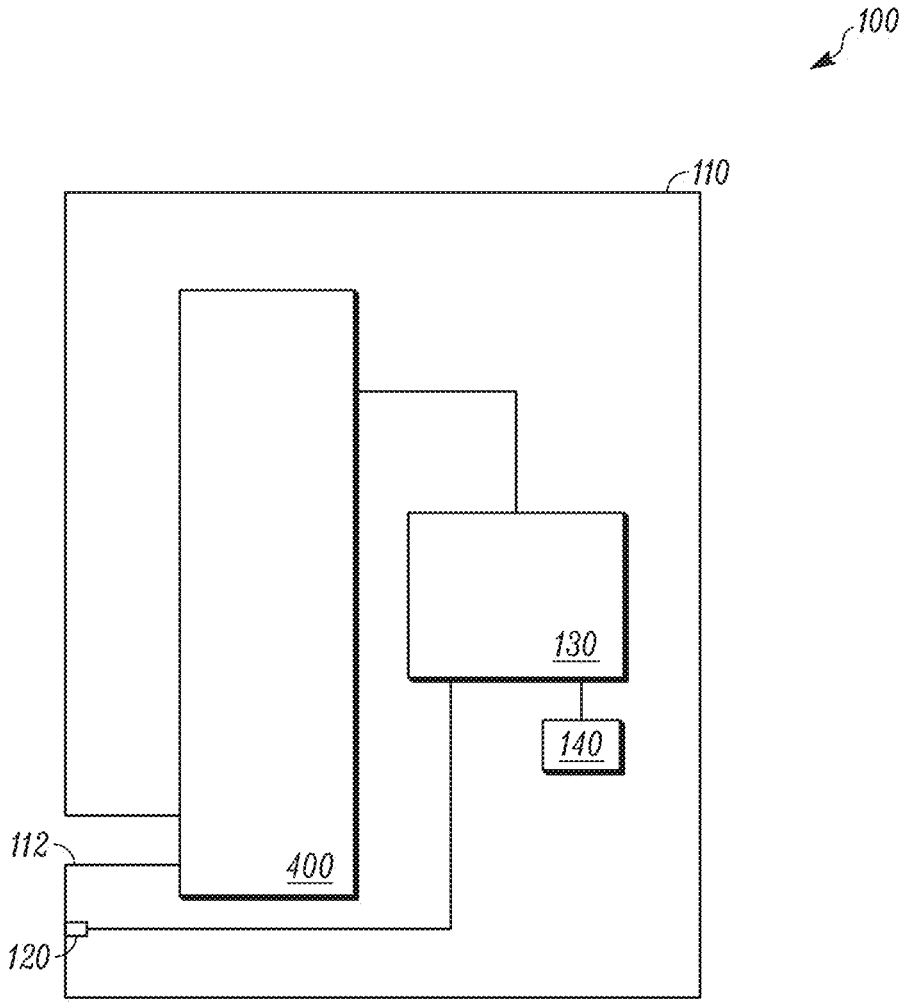
FIG. 1 is schematic view of a lid dispensing system, according to an example embodiment.

All Figures are illustrated for ease of explanation of the basic teachings of the present invention only; the extensions of the Figures with respect to number, position, relationship and dimensions of the parts to form the preferred embodiment will be explained or will be within the skill of the art after the following description has been read and understood. Further, the exact dimensions and dimensional proportions to conform to specific force, weight, strength, and similar requirements for various applications will likewise be within the skill of the art after the following description has been read and understood.

Where used in various figures of the drawings, the same numerals designate the same or similar parts. Furthermore, when the terms "top," "bottom," "right," "left," "front," "rear," "first," "second," "inside," "outside," and similar terms are used, the terms should be understood to reference only the structure shown in the drawings and utilized only to facilitate describing the illustrated embodiments.

FIG. 1 is schematic view of a lid dispensing system 100, according to an example embodiment. The lid dispensing system 100 includes a housing 110. Positioned within the housing 110 is a sensor 120 and a dispensing mechanism 400. The housing 100 includes an opening 112 therein. Lids as dispensed are passed through the opening 112 when dispensed. The opening 112 can also be termed as a slot dimensioned to allow the lids of a certain size to pass. Positioned near the opening 112 is the sensor 120. The sensor can include a light sensor 120 or the like. The sensor 120 responds to a hand being placed near the opening 112. In actuality, the sensor 120 responds to a change in an amount of light striking the sensor 120, such as would be caused by the presence of a person's hand. The change in light typically will be adjusted so that the dispenser will not dispense in response to any change, but only to a change characteristic of hand placement in front of the sensor 120. The signature associated with a hand being placed in front of the sensor can be programmed into a processor 130 communicatively coupled to the sensor 120 and the dispensing mechanism 400. Communicatively coupled to the processor 130 is memory 140. The memory 140, in some embodiments, can store an instruction set which when executed by the processor 130 enables the dispensing mechanism 400 to dispense lids. For example, the processor 130, upon receiving a signature signal indicative of a hand in from of the sensor 120 will enable the dispensing mechanism 400 to dispense one lid and deliver it through the opening 112 to a position where the user can either grab the lid with his or her fingers, or to a position where it drops onto the users hand. The various signatures indicative of a hand near the sensor 120 can be stored in the memory 140. The processor 130 will compare the signal received from the sensor 120 to the various signatures stored in memory 140. When there is a match to one of the signatures, a lid will be dispensed by the dispensing mechanism 400. The hand will not touch the stack of lids associated with the dispensing mechanism 400. The dispensing mechanism 400 will be further detailed below in FIGS. 4-7.

Figure 2:
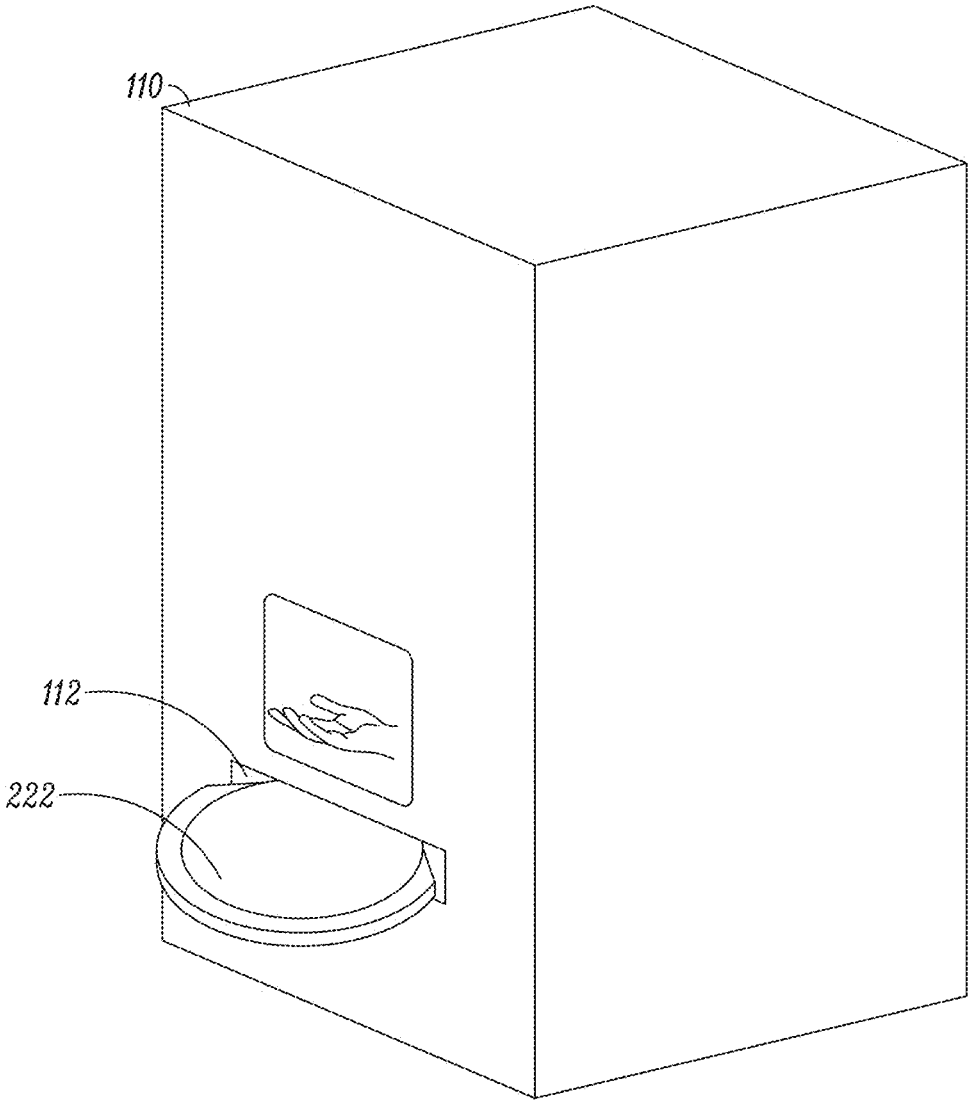
FIG. 2 is a perspective view of a lid dispensing system for dispensing a single size of lid, according to an example embodiment.

FIG. 2 is a perspective view of a lid dispensing system 100 for dispensing a single size of lid, according to an example embodiment. The housing 110 is shown having a single slot or opening 112. The opening 112 is sized to allow a lid 222 of a selected size to pass through the slot or opening 112. The dispensing mechanism 400 (shown in FIGS. 1 and 4-7) is enabled by detecting the presence of a user's hand. The lid 222 is removed from a stack of lids and presented to the user after it passes through the slot or opening 112.

Figure 3:
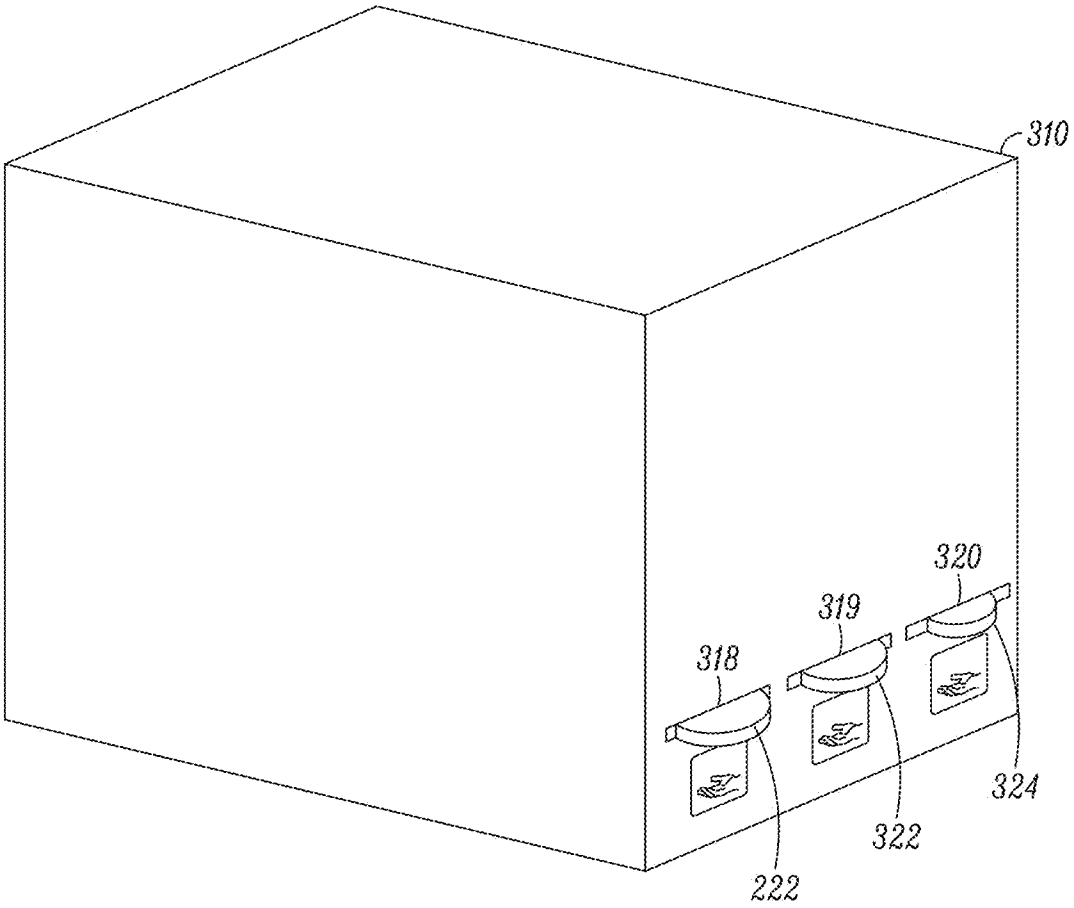
FIG. 3 is a perspective view of a lid dispensing system for dispensing multiple sizes of lids, according to an example embodiment.

FIG. 3 is a perspective view of a lid dispensing system 300 for dispensing multiple sizes of lids 222, 322 and 324, according to an example embodiment. The lid dispensing system 300 includes a housing 310. The housing 310 includes a first opening 318, a second opening 319, and a third opening 320. The openings 318, 319, 320 are of different sizes. Different sized lids are also dispensed through the openings 318, 319 320. A dispensing mechanism 400 is associated with each of the openings 318, 319, 320. The dispensing mechanism 400 for each is substantially the same other than for the fact that each dispensing mechanism holds a different sized lid, such as a small lid 324 for dispensing through the third opening 320, a medium-sized lid 322 for dispensing through the second opening 319, and a large lid 222 for dispensing through the first opening 318. There is a sensor (not shown) associated with each of the openings 318, 319, 320. The sensor senses when a hand is present or positioned near one of the openings 318, 319, 320. In response to sensing a hand near one of the openings, the corresponding dispensing mechanism 400 is enabled and a lid of the appropriate size is dispensed through the one of the openings that the hand is near.

Figure 4:
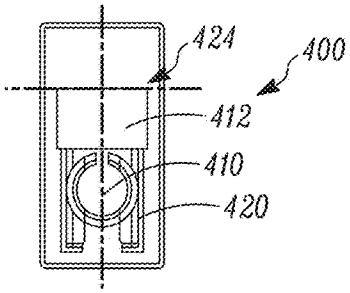
FIG. 4 is top view of a dispensing mechanism within the housing of the lid dispensing system, according to an example embodiment.
Figure 5:
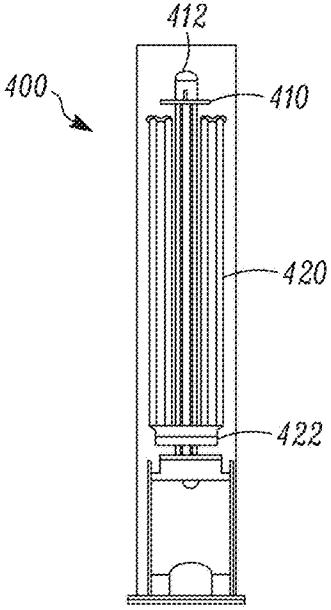
FIG. 5 is a front view of a dispensing mechanism within the housing of the lid dispensing system, according to an example embodiment.
Figure 6:
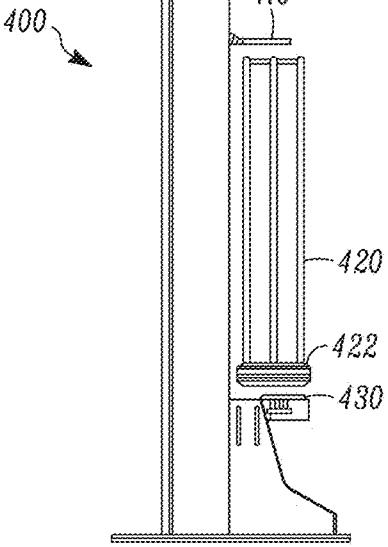
FIG. 6 is a side view of a dispensing mechanism within the housing of the lid dispensing system, according to an example embodiment.

FIG. 4 is top view of a dispensing mechanism 400 of the lid dispensing system 100, 300, according to an example embodiment. FIG. 5 is a front view of a dispensing mechanism 400 of the lid dispensing system 100, 300, according to an example embodiment. FIG. 6 is a side view of the lid dispensing system 100, 300, according to an example embodiment. Now referring to FIGS. 4-6, the dispensing mechanism 400 will be further discussed. The dispensing mechanism 400 can be sized to handle different sized lids 222, 322, 324. The dispensing mechanism 400 includes a paddle 410 which is coupled to a mechanism to move the paddle 412. The paddle moving mechanism 412 can be a screwdriver or other mechanism that moves the paddle incrementally. The dispensing mechanism 400 also includes a hopper 420 for holding a stack of lids, such as lids 222. The hopper 420, in the embodiment shown, includes a number of elongated rods which are positioned to allow a stack of lids to pass freely between them. The rods are positioned so that the distance between the rods is roughly equal to a distance slightly larger than the diameter of the lids 222. The hopper 420 also includes a separator 422. The separator separates one lid 222 from the stack of lids. When the stack, the lids are held together by a friction force. When the bottom of the stack of lids is passed by the separator 422, the bottom lid 222 drops from the stack of lids. The paddle 412 is sized to contact a major surface of a lid, such as lid 222, at the top of a stack of lids.

A stack of lids 222 is positioned within the hopper 420. The paddle moving mechanism 412 is used to move the paddle 410 a distance which will cause the bottom lid in the stack to be freed from the stack of lids 222. The distance that the paddle moves can be a set distance, or can be a distance determined by a closed loop control system. In one embodiment, the paddle moves a set distance each time a lid is dispensed. For example the set distance may be ¼ inch. This distance would move the stack of lids down one quarter of an inch so that the last or bottommost lid in the stack passes the separator and drops from the stack of lids. In another embodiment, the paddle is moved until the bottom lid in the stack of lid straps and then the paddle stops. This would be a close loop system which require additional sensors to determine when a lid dropped from the stack of lids. The paddle moves with the top lid in the stack of lids so that the paddle can contact the top lid and cause the whole stack to move past the separator 420 each time a hand or is detected near the opening in the housing (shown in FIGS. 1-3). Once the stack is moved beyond the separator a single literal drop onto a conveyor 430 (shown in FIG. 6) which conveys the lid 222 through the corresponding opening in the housing 110, 310.

The hopper 420 includes a door 424. When the paddle 420 moves to an end position near the separator 422, a new stack of lids has to be inserted into the hopper 420. The door 424 is opened. The paddle 410 is moved from an end position to a start position near or at the top of the stack of lids. The stack of lids is placed into the hopper 420. The paddle 410 is moved into contact with the major surface of the lid at the top of the stack of lids 222. The door 424 is closed and then the dispenser or dispensing mechanism 400 dispenses one lid at a time from the stack of lids 222 onto the conveyor 430. The conveyor 430 moves the lid 222 are one opening and to the hand of a user.

Figure 7:
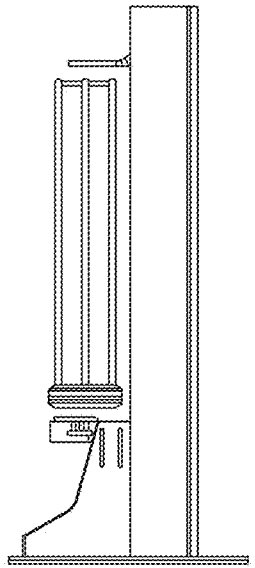
FIG. 7 is another side view of a dispensing mechanism within the housing of the lid dispensing system, according to an example embodiment.

FIG. 7 is another side view of the dispenser from the side opposite that shown in FIG. 6.

Figure 8:
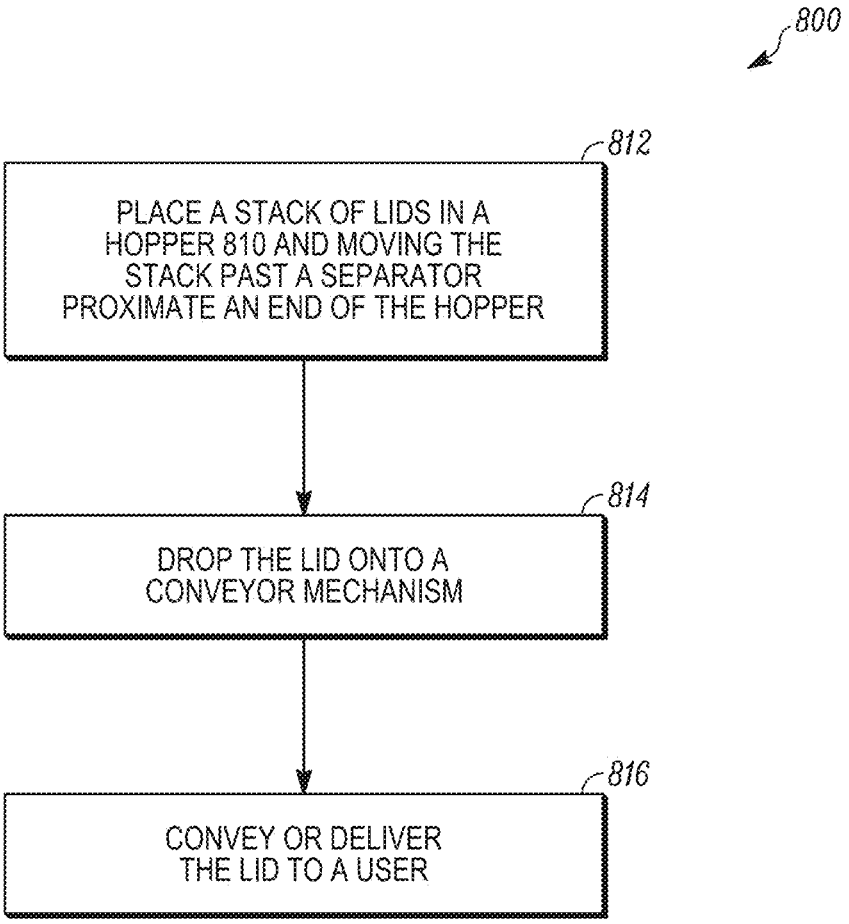
FIG. 8 is a method for dispensing a lid from a lid dispensing system, according to an example embodiment.

FIG. 8 is a flowchart of a method 800 dispensing lids, according to an example embodiment. The method 800 includes placing a stack of lids in a hopper 810 and moving the stack past a separator proximate an end of the hopper 812. In one embodiment, moving the stack past a separator proximate an end of the hopper is accomplished by placing a force on a paddle at an opposite end of the stack. The paddle places a force on a major surface of at least one of the lids in the stack. The separator separates one lid from the stack of lids. The method 800 includes dropping the lid onto a conveyor mechanism 814, and conveying or delivering the lid to a user. In one embodiment, a lid dispenser is positioned inside a housing and the lid is delivered through an opening in the housing to the user outside the housing.

Figure 9:
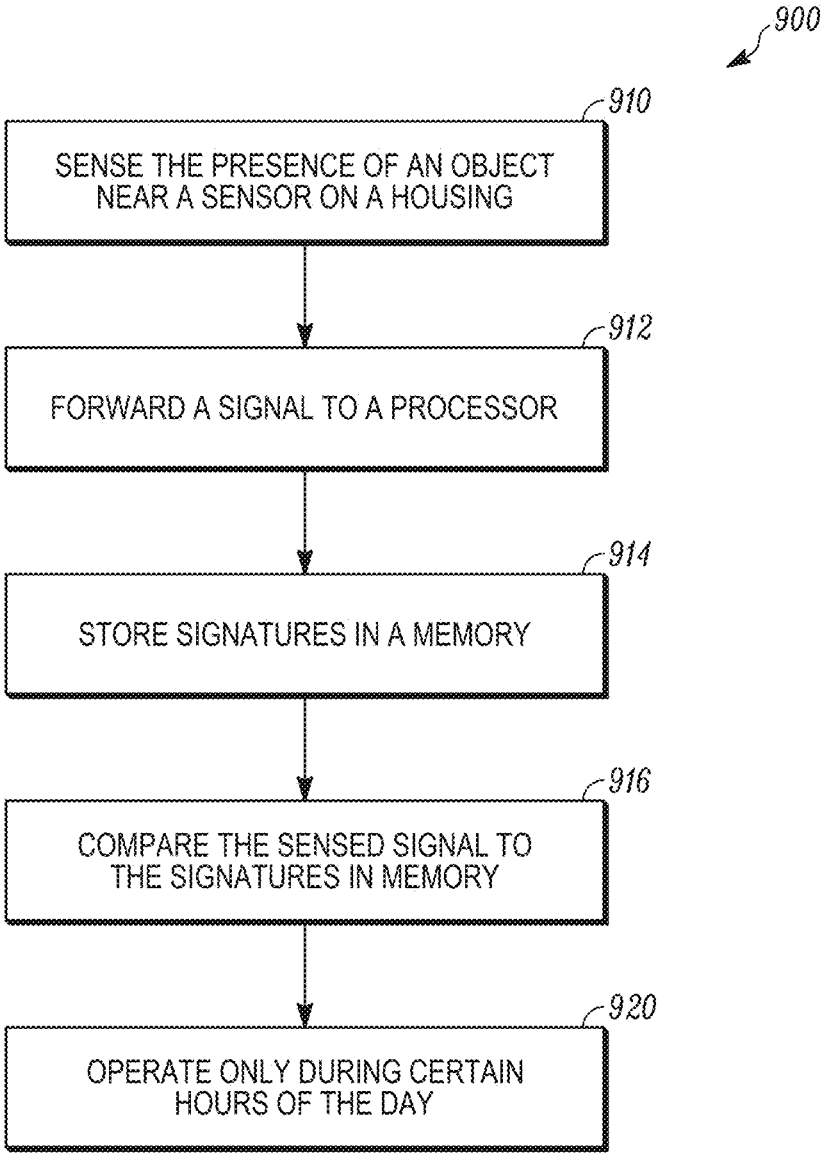
FIG. 9 is a method for dispensing a lid from a lid dispensing system, according to another example embodiment.

FIG. 9 is another method 900 for dispensing a lid from a lid dispensing system, according to another example embodiment. The method 900 includes sensing the presence of an object near a sensor on a housing 910 and forwarding a signal to a processor 912. The method also includes storing signatures in a memory 914. The signals are then compared to the signatures in memory 916. If there is a match, a lid is dispensed 918. If there is no match, the lid dispenser awaits further signals from the sensor. The method 900 can also be directed to operate only during certain hours of the day 920. For example, the hours of operation could correspond to the hours of operation of a restaurant which uses the dispensing mechanism. It should be noted that when a lid is dispensed, the method 800 can be used.

Figure 10:
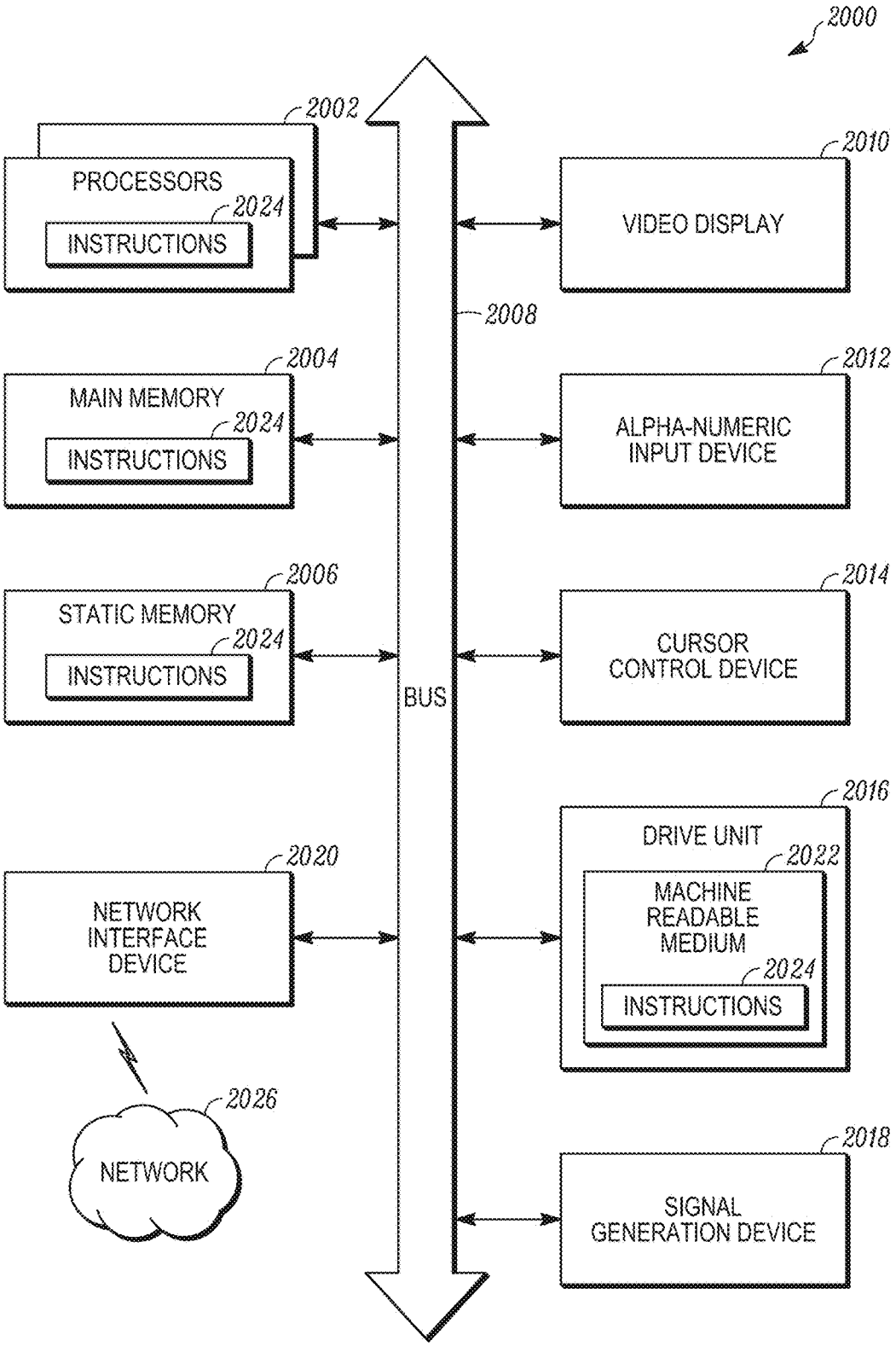
FIG. 10 shows a diagrammatic representation of a computing device for a machine in the example electronic form of a computer system, according to an example embodiment.

FIG. 10 shows a diagrammatic representation of a computing device for a machine in the example electronic form of a computer system 2000, within which a set of instructions for causing the machine to perform any one or more of the methods 800, 900 or operations discussed herein and which can be executed or is adapted to include the apparatus for making various settings as described herein. In various example embodiments, the machine operates as a standalone device or can be connected (e.g., networked) to other machines. In one embodiment, the computer system is a microprocessor 220 and memory 230 of an electronic machine (shown in FIGS. 2 and 7 and discussed above). In a networked deployment, the machine can operate in the capacity of a server or a client machine in a server-client network environment, or as a peer machine in a peer-to-peer (or distributed) network environment. The machine can be a personal computer (PC), a tablet PC, a set-top box (STB), a Personal Digital Assistant (PDA), a cellular telephone, a portable music player (e.g., a portable hard drive audio device such as an Moving Picture Experts Group Audio Layer 3 (MP3) player, a web appliance, a network router, a switch, a bridge, or any machine capable of executing a set of instructions (sequential or otherwise) that specify actions to be taken by that machine. Further, while only a single machine is illustrated, the term "machine" shall also be taken to include any collection of machines that individually or jointly execute a set (or multiple sets) of instructions to perform any one or more of the methodologies discussed herein.

The example computer system 2000 includes a processor or multiple processors 2002 (e.g., a central processing unit (CPU), a graphics processing unit (GPU), arithmetic logic unit or all), and a main memory 2004 and a static memory 2006, which communicate with each other via a bus 2008. The computer system 2000 can further include a video display unit 2010 (e.g., a liquid crystal displays (LCD) or a cathode ray tube (CRT)). The computer system 2000 also includes an alphanumeric input device 2012 (e.g., a keyboard), a cursor control device 2014 (e.g., a mouse), a disk drive unit 2016, a signal generation device 2018 (e.g., a speaker) and a network interface device 2020.

The disk drive unit 2016 includes a computer-readable medium 2022 on which is stored one or more sets of instructions and data structures (e.g., instructions 2024) embodying or utilized by any one or more of the methodologies or functions described herein. The instructions 2024 can also reside, completely or at least partially, within the main memory 2004 and/or within the processors 2002 during execution thereof by the computer system 2000. The main memory 2004 and the processors 2002 also constitute machine-readable media.

The instructions 2024 can further be transmitted or received over a network 2026 via the network interface device 2020 utilizing any one of a number of well-known transfer protocols (e.g., Hyper Text Transfer Protocol (HTTP), CAN, Serial, or Modbus).

While the computer-readable medium 2022 is shown in an example embodiment to be a single medium, the term "computer-readable medium" should be taken to include a single medium or multiple media (e.g., a centralized or distributed database, and/or associated caches and servers) that store the one or more sets of instructions and provide the instructions in a computer readable form. The term "computer-readable medium" shall also be taken to include any medium that is capable of storing, encoding, or carrying a set of instructions for execution by the machine and that causes the machine to perform any one or more of the methodologies of the present application, or that is capable of storing, encoding, or carrying data structures utilized by or associated with such a set of instructions. The term "computer-readable medium" shall accordingly be taken to include, but not be limited to, solid-state memories, optical and magnetic media, tangible forms and signals that can be read or sensed by a computer. Such media can also include, without limitation, hard disks, floppy disks, flash memory cards, digital video disks, random access memory (RAMs), read only memory (ROMs), and the like.

The example embodiments described herein can be implemented in an operating environment comprising computer-executable instructions (e.g., software) installed on a computer, in hardware, or in a combination of software and hardware. Modules as used herein can be hardware or hardware including circuitry to execute instructions. The computer-executable instructions can be written in a computer programming language or can be embodied in firmware logic. If written in a programming language conforming to a recognized standard, such instructions can be executed on a variety of hardware platforms and for interfaces to a variety of operating systems. Although not limited thereto, computer software programs for implementing the present method(s) can be written in any number of suitable programming languages such as, for example, Hypertext Markup Language (HTML), Dynamic HTML, Extensible Markup Language (XML), Extensible Stylesheet Language (XSL), Document Style Semantics and Specification Language (DSSSL), Cascading Style Sheets (CSS), Synchronized Multimedia Integration Language (SMIL), Wireless Markup Language (WML), Java™, Jini™, C, C++, Perl, UNIX Shell, Visual Basic or Visual Basic Script, Virtual Reality Markup Language (VRML), ColdFusion™ or other compilers, assemblers, interpreters or other computer languages or platforms.

Figure 11:
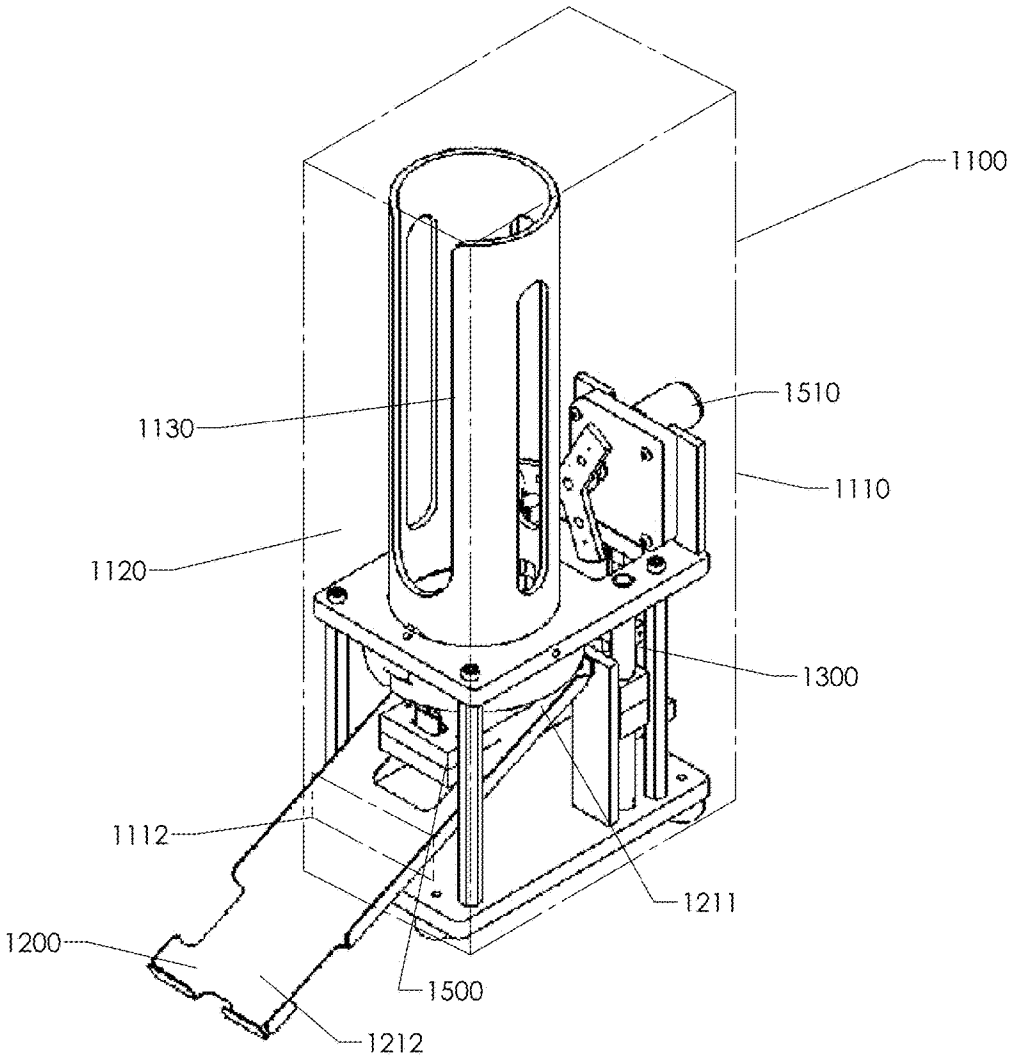
FIG. 11 is a perspective view of a lid dispensing system, according to another example embodiment.

FIG. 11 is a perspective view of a lid dispensing system 1100, according to another example embodiment. The lid dispensing system 1100 includes a housing 1110. The housing 1110 is shown in hidden lines for the sake of clarity. The internal portion of the lid dispensing system is set forth in solid lines. In addition to the housing 1110, the lid dispensing system 1100 includes a sensor 1120 and a hopper 1130 for holding a stack including a plurality of lids. The sensor 1120 senses an object outside the housing 1110. Upon determining that there is an object outside the housing 1110, an apparatus for picking a single lid 1421 from the stack of lids held by the hopper 1400 picks a single lid 1421 from a stack of lids (not shown) and dispenses the single lid 1421 to a position outside the housing 1110. The lid dispensing system 1100 includes a slide 1200 having a portion 1211 within the housing 1110 and another portion 1212 outside the housing 1110. The apparatus for picking the single lid 1400 places a single lid (not shown) on a portion 1212 of the slide 1200 within the housing. The lid slides along the slide 1200 to the position outside the housing 1110. The housing 1110 includes a slot or opening 1112 therein.

Figure 12:
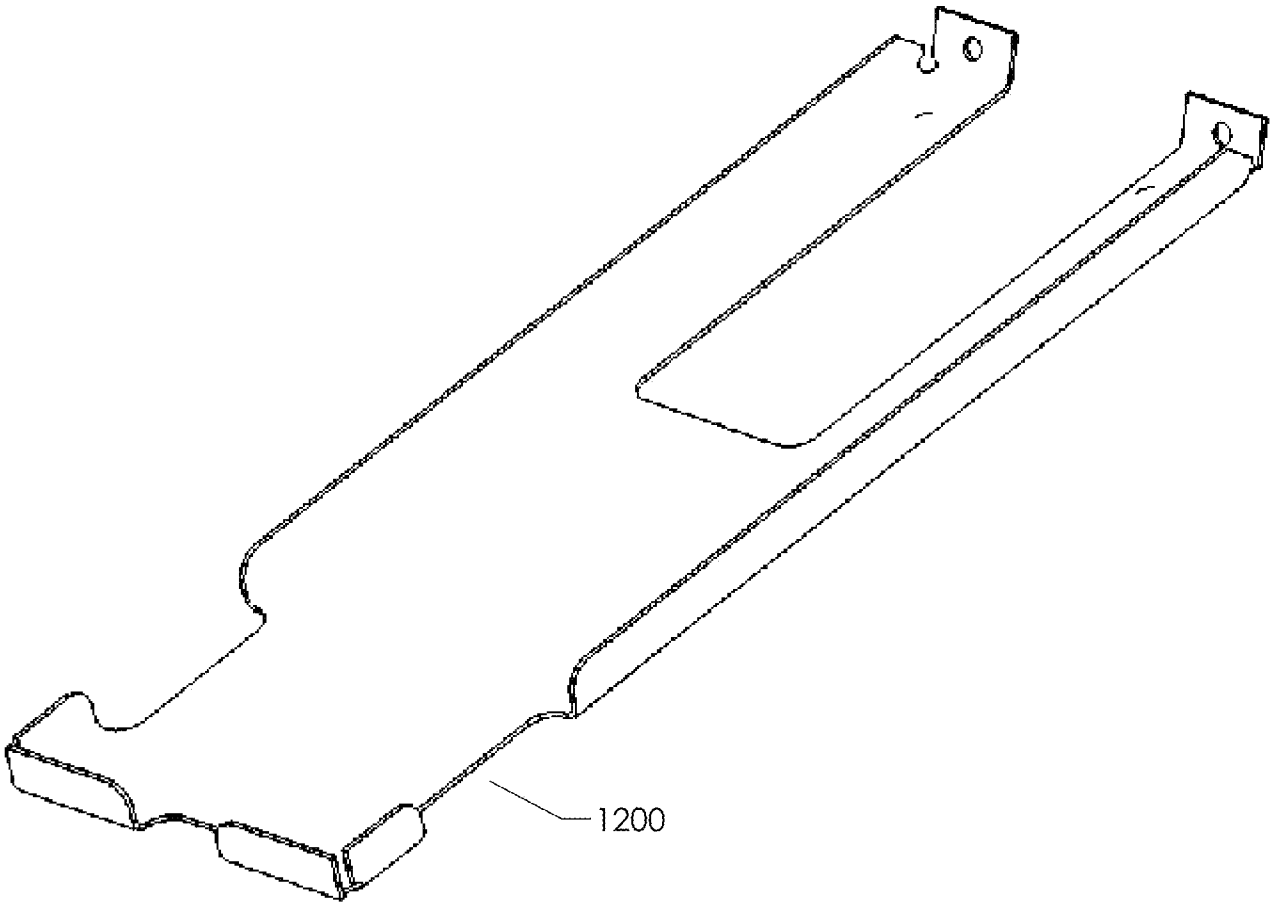
FIG. 12 is a perspective view of a tray for the lid dispensing system, according to another example embodiment.

FIG. 12 is a perspective view of a tray or slide 1200 for the lid dispensing system, according to another example embodiment. The tray or slide 1200 includes a portion 1212 which fits and which is situated inside the housing 1110 substantially directly below or in line with the hopper 1130. The slide 1200 includes an opening 1220 therein. The opening 1220 allows the apparatus for picking 1400 to pass through the slide 1200. The apparatus for picking 1400 includes a shuttle 1500 which has fingers 1521, 1522 for engaging the inner rim or inner surface of the single lid. The lid 1421 has a diameter which is less than the width of the slide and more than the width of the slot 1220 in the slide 1200. As the shuttle 1500 moves through the slot 1220, the lid 1421 contacts the slide 1200 and is peeled off. In other words, the lid 1421 is removed from the fingers 1521, 1522 as it contacts the slide outside the slot 1220. The lid is placed onto the slide on the portion 1211 of the slide 1200 within the housing 1100. The slide 1200 is inclined, in the embodiment shown in FIG. 11. The top of the slide 1200 is within the housing and the bottom of the slide 1200 is outside the housing. The lid 1421 then slides down the slide to a position outside the housing or to the portion of the slide 1212 outside the housing. When the lid 1421 is on the portion of the slide 1212 outside the housing, the lid may be picked up for use by an operator or user. Thus, gravity is used to automatically feed the lid 1421 to a dispensing position.

Figure 13:
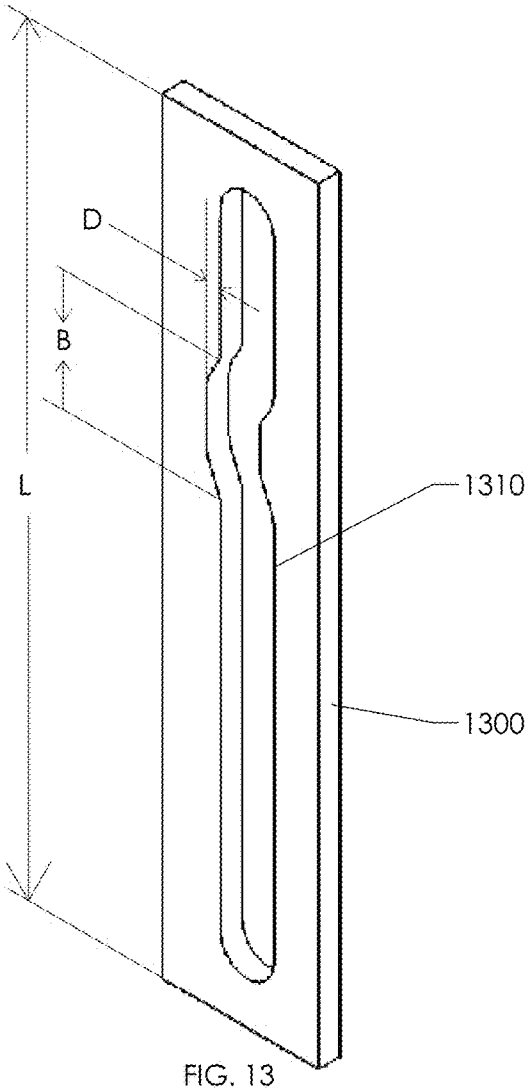
FIG. 13 is a perspective view of a cam surface for the lid dispensing system, according to another example embodiment.
Figure 14:
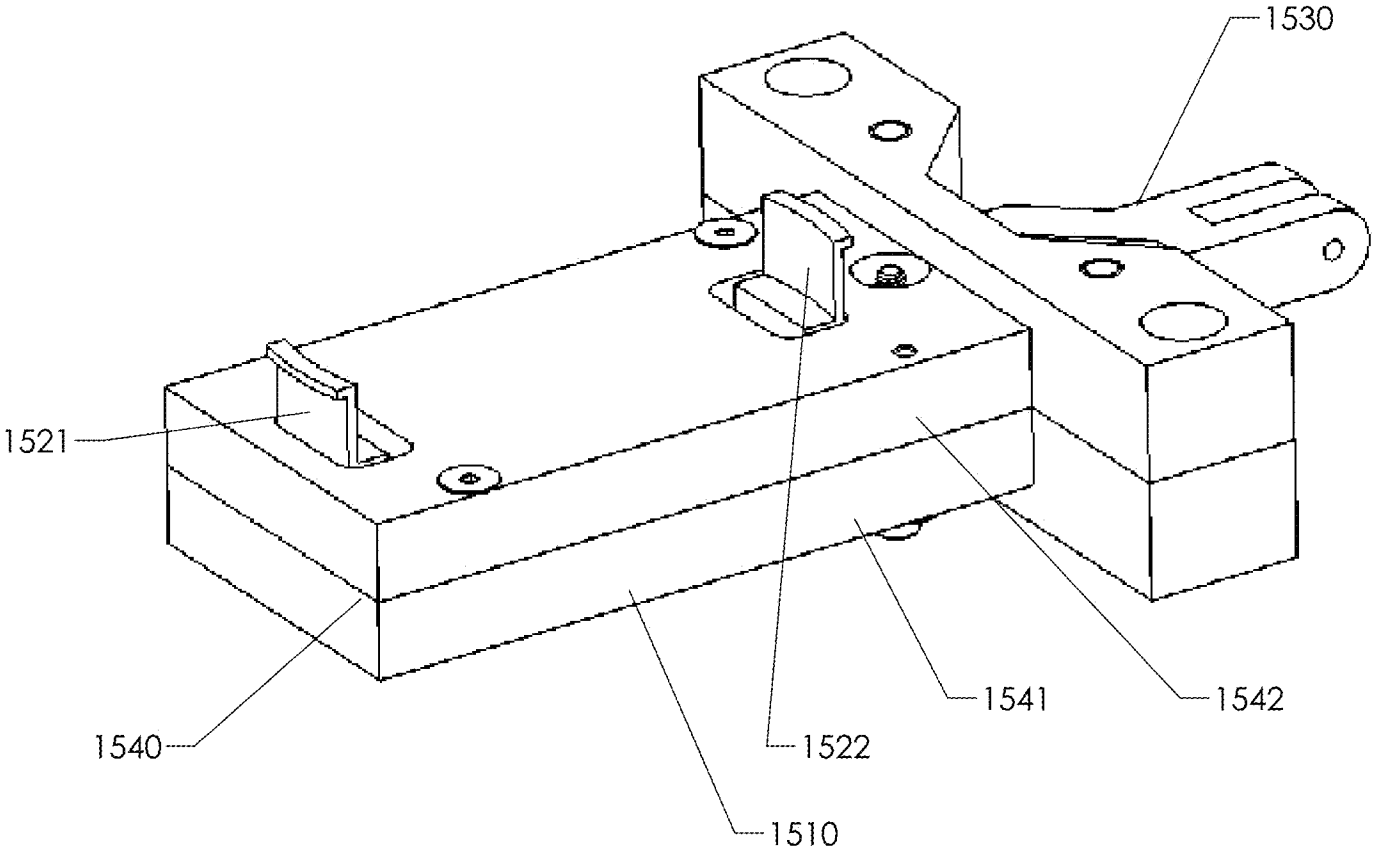
FIG. 14 is a perspective view of a shuttle mechanism for the lid dispensing system, according to an example embodiment.
Figure 15:
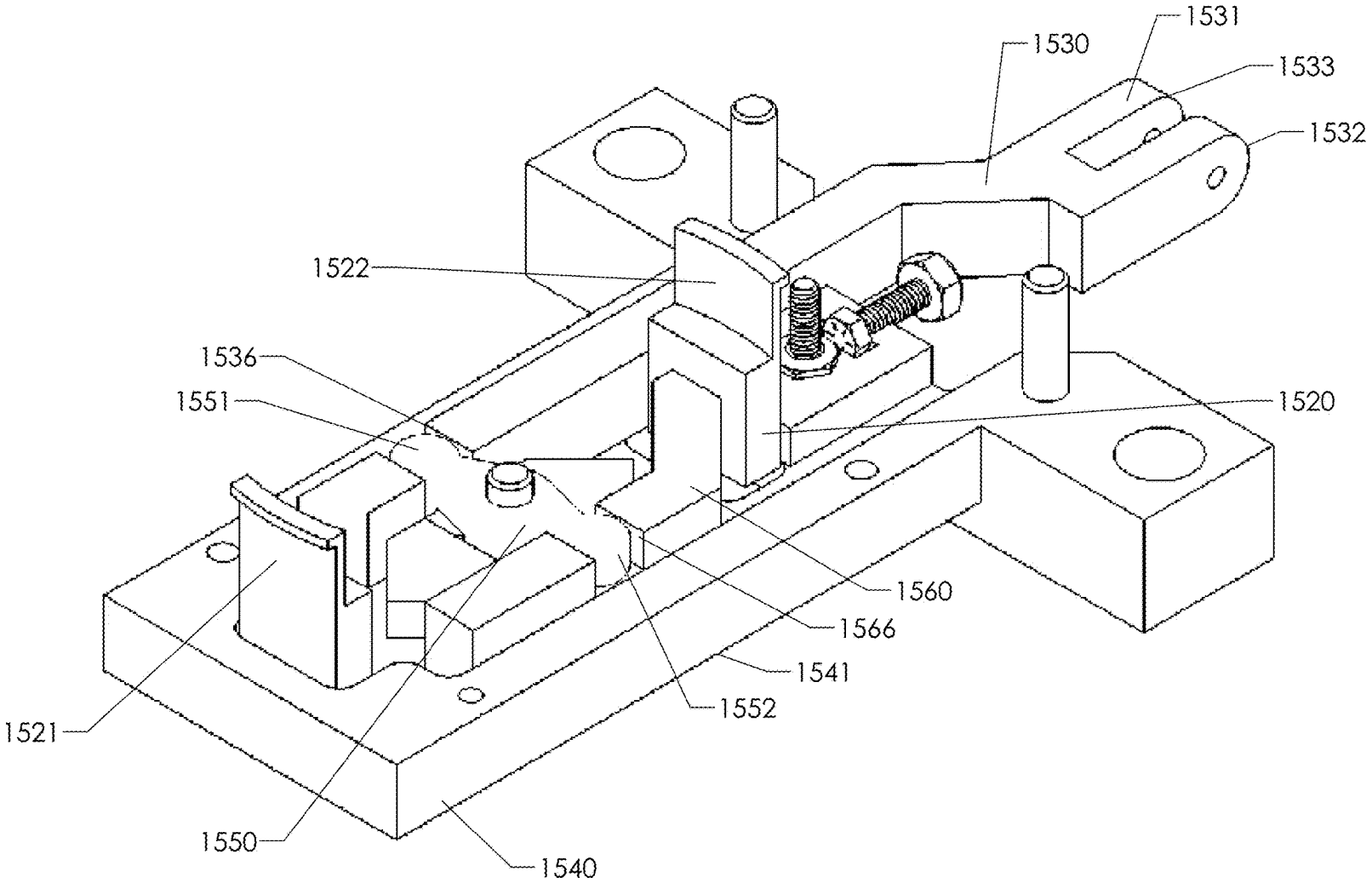
FIG. 15 is a perspective view of a shuttle mechanism for the lid dispensing system with one half of a clam shell cover removed, according to an example embodiment.

FIG. 14 is a perspective view of a shuttle mechanism 1500 for the lid dispensing system 1110, according to an example embodiment. FIG. 15 is a perspective view of a shuttle mechanism 1500 for the lid dispensing system with one half of a clam shell cover removed, according to an example embodiment. FIG. 13 is a perspective view of a cam 1300 that includes a cam surface 1310 for the lid dispensing system 1110, according to another example embodiment. FIGS. 13-15 will now be used to further detail an example embodiment of the invention. The FIGs. will be discussed in more detail after an overview discussion. The apparatus for picking 1500 a single lid 1421 (shown in FIG. 14) from the stack of lids 1500 includes an actuator 1510, a cam 1300 having a cam surface 1310, a shuttle 1520, and a cam follower 1530. The shuttle 1520 is operably connected to the actuator 1510. The actuator 1510 moves the shuttle 1520 with respect to the cam surface 1310. The shuttle 1520 also includes a first finger 1521, and a second finger 1522. At least one of the first and second fingers 1521, 1522, respectively, is moved to engage an interior surface of the single lid. The cam follower 1530 is attached to at least one of the first and second fingers 1521, 1522 to move at least one of the first and second fingers 1521, 1522 into and out of engagement with a single lid, such as 1421 shown in FIG. 14. The first finger 1521 and the second finger 1522 are movable between an engaged position and a disengaged position. The first and second fingers, 1521, 1522 in one embodiment, engage an interior surface 1420 of the single lid 1421. A cam follower 1530 is operably attached to the first and second fingers 1521, 1522 and moves the first and second fingers 1521, 1522 into and out of engagement with a single lid 1421.

Now turning to FIG. 13 is a perspective view of a cam 1300 that includes a cam surface 1310 for the lid dispensing system 1110 will be further discussed. The cam 1300 includes a cam surface 1310. The cam 1300 is basically a flat plate of metal or other durable material. The flat place includes a specially shaped slot which serves as the cam surface 1310. As mentioned above, the cam follower 1530 includes an end which interacts or engages the cam surface 1310. The cam surface is of sufficient length to accommodate the entire length of travel of the shuttle 1520. The shuttle is moved along the cam surface 1310 by the actuator 1510. In this particular embodiment, the actuator rotates through substantially 360 degrees. A shaft links the actuator 1510 and the shuttle 1520, according to another example embodiment. The cam surface 1310 converts the rotary motion to substantially linear motion. The cam surface includes a bump out having a length B as shown in FIG. 13. This causes the cam follower to move substantially vertically during the up and down movement through most of the cycle within the length L of the cam surface. The bump out 1312 serves to move the first and second fingers 1521, 1522 between an engaged position to a disengaged (stack release position). Of course, the length, B, of the bump out 1312 portion can be modified to provide for different amounts of time that the fingers 1521, 1522 are in the disengaged position with respect to the lid at the bottom of a stack of a plurality of lids. It should also be noted that the depth, D, of the bump out 1310 portion can also be adjusted. This adjustment determines the amount of movement between the engaged and disengaged position. The cam 1300, in this embodiment, is made to be interchangeable with other cams. In this way, differences in the geometry of various lids can be accommodated. The cam 1300 shown is contemplated to be useful for one of a number of lids from various lid manufacturers. It is contemplated that other lids might have different geometries, such as different inside diameters where a particular lid is engaged. The cams are interchangeable so that a universal cam can be easily exchanged on the lid dispensing apparatus. In this way, different types of lids may be picked off the bottom of a stack of lids held by the hopper 1130. The dispensing mechanism 1110 includes a slot in which the cam 1300 can be firmly secured. The cam 1300 can be changed out, as needed. For example, if a dispenser was to be converted to handling a different manufacturer's lids, the cam could be changed so that the dispenser 1100 operated properly or more efficiently. It should be noted that the actuator 1510 shown in this example embodiment is a rotary actuator. It should be understood that a linear actuator could also be employed in another example embodiment. In the example shown here, the actuator is a motor. In another embodiment, the actuator is a manually driven device. It should also be noted that in the example embodiment, a single actuator is used to perform the many tasks of the dispensing mechanism. The use of the shuttle 1520 and the cam 1300 and cam follower as well as the wedge for driving the gripping mechanism apart allows for the many necessary motions to be accomplished by the one actuator.

Now turning to FIGS. 14 and 15, the shuttle mechanism 1520 will be further detailed. FIG. 14 is a perspective view of a shuttle mechanism 1520 for the lid dispensing system 1110, according to an example embodiment. FIG. 15 is a perspective view of a shuttle mechanism 1520 for the lid dispensing system with one half of a clam shell cover removed, according to an example embodiment. The housing 1540 for the shuttle mechanism 1520 is comprised of two half shells 1541, 1542. In the example embodiment shown, the half shells 1541 and 1542 are interchangeable with one another. In this manner, manufacturing and assembly is eased. Manufacturing requires only a single mold, if a mold were to be made. If machined, only one part needs to be machined. The parts 1541, 1542 are interchangeable so that there is no need to pick separate parts to form the body of the shuttle mechanism 1520.

Figure 16:
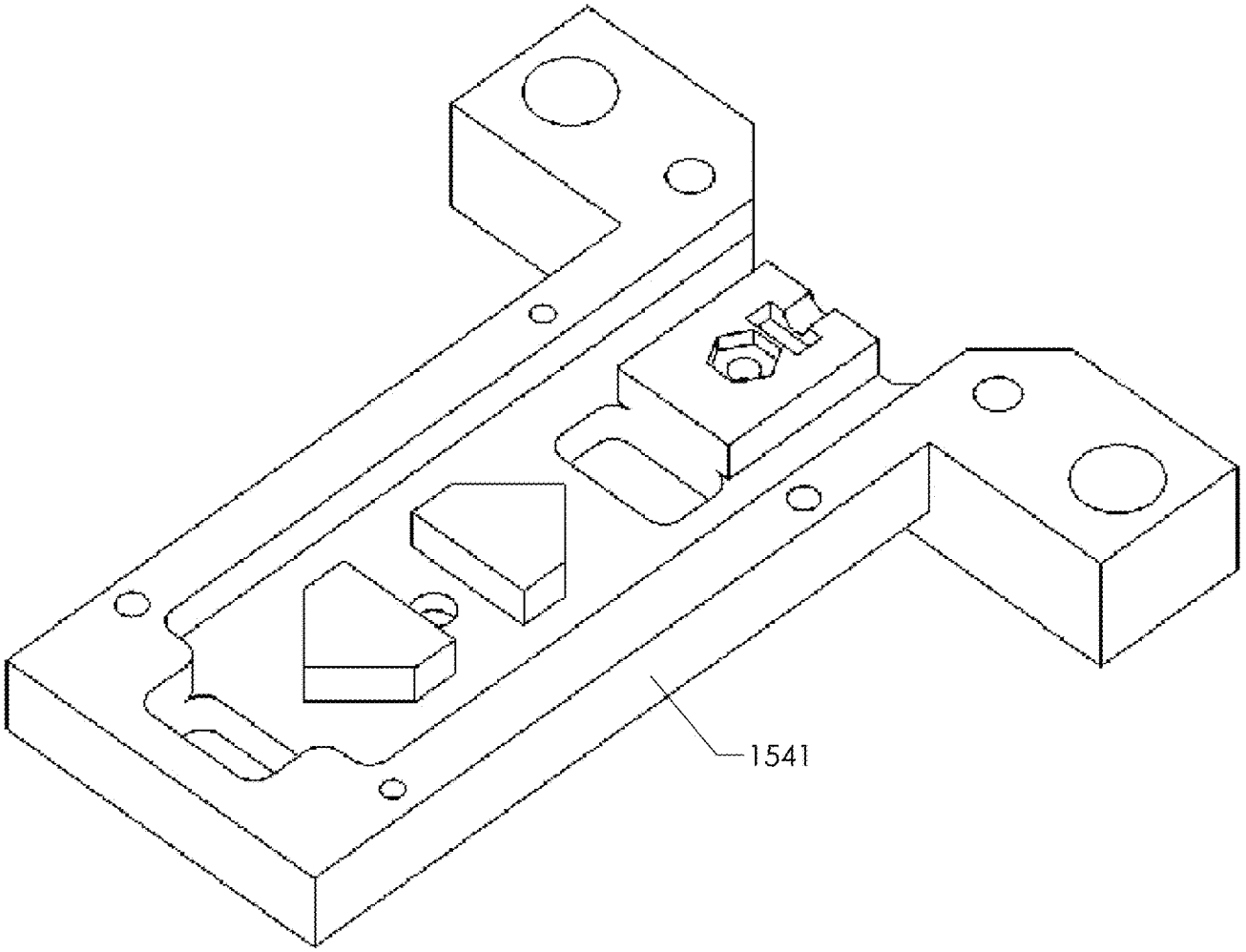
FIG. 16 is a perspective view of one of the half shells, according to an example embodiment.

FIG. 16 shows one of the half shells 1541, according to an example embodiment. The halfshell 1541 includes various openings for receiving parts that form the shuttle mechanism 1520. The halfshell 1541 also includes openings for receiving fasteners or for receiving pins to properly align one halfshell 1541 with another halfshell 1542, as shown in FIG. 14.

Figure 17:
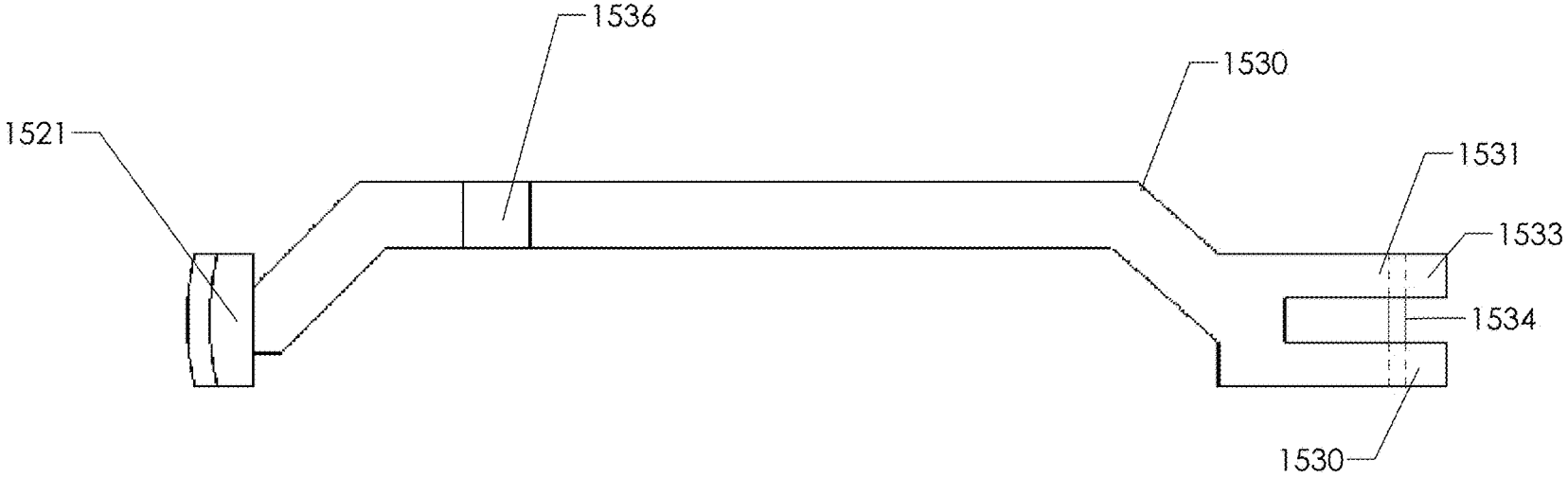
FIG. 17 is a top view of the cam follower, according to an example embodiment.

FIG. 17 includes a top view of the cam follower 1530, according to an example embodiment. The cam follower 1530 includes a first end 1531 and the second end 1521. The second end 1521 is one of the fingers used to engage the inner portion of a lid and pick the lid from a stack of lids held by the hopper 1130. The first end 1531 is a fork like and includes an opening 1532 and an opening 1533. The cam 1300 fits between the two forks of the first end 1531. The fork or first and 1531 is fit over the cam fit 1300 with the two openings 1532, 1533 near the cam surface 1310. An appropriately sized pin 1534 is passed through the first opening 1532, the second opening 1533 and the slot that forms the cam surface 1310. The pin 1534 is unable to ride or engage the cam surface 1310 as the shuttle 1520 is moved up and down by the actuator 1510. The cam follower 1530 has an elongated middle portion that includes a slot 1536. The cam follower 1530 fits along one side of the depressions in the halfshell 1541. Rotatably attached to the halfshell 1541 is a link 1550. The link 1540 has a first rounded end 1551 and a second rounded end 1552. The first rounded and 1551 fits within the slot 1536 of the cam follower 1530. The shuttle also includes a link follower 1560 which has a slot 1566 therein. The second rounded end 1552 fits within the slot 1566. Attached to one end of the link follower 1560 is the second finger 1522.

In operation the cam follower 1530 moves as dictated by the cam surface 1310 of the cam 1300. When the cam follower 1530 moves, the slot 1536 also moves. This rotates the link 1550 and then causes the link follower 1560 to move in an opposite direction from the cam follower 1530. The second finger 1522 is attached to an end of the link follower 1560. Both the link follower 1560 and the cam follower 1530 are constrained by depressions and various features of the halfshell 1541, as shown in FIG. 15. As mentioned previously, the halfshell 1541 and 1542 are interchangeable parts. To complete the shuttle assembly 1520 the other halfshell 1542 is placed on top of the halfshell 1541 and the two are attached to one another to form a completed shuttle and shuttle mechanism 1520. Should be noted that there are adjustment mechanisms within the shuttle 1520 so that various adjustments can be made to fine tune the shuttle as it moves over the camming surface 1310.

Figure 18:
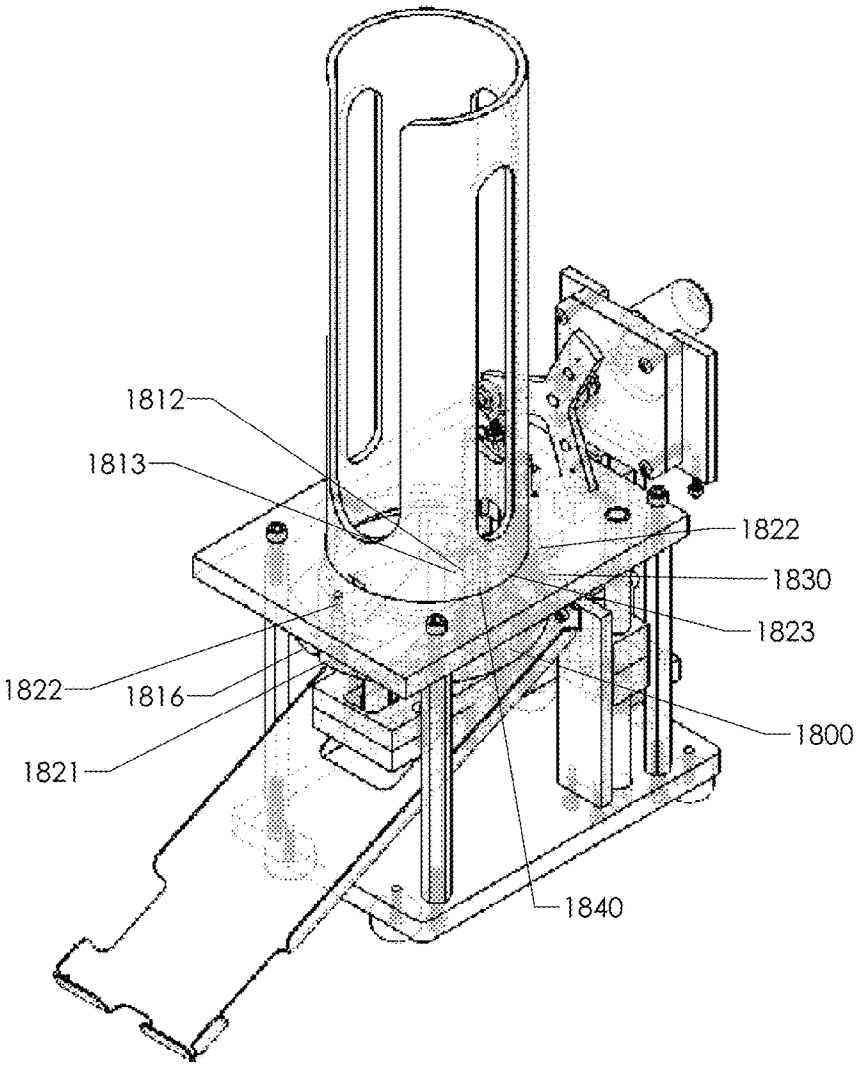
FIG. 18 is a perspective view of a dispensing mechanism of the lid dispensing system showing the stack gripping and release mechanism, according to an example embodiment.

FIG. 18 is a perspective view of a dispensing mechanism of the lid dispensing system showing the stack gripping and release mechanism 1800, according to an example embodiment. The stack gripping and release mechanism 1800 includes a stack gripper 1810 for gripping a stack of lids. The stack gripper 1810 includes a first c-shaped portion 1811, and a second c-shaped portion 1821 pivotally attached to the first c-shaped portion 1811 at a pivot 1822. The stack gripper also includes a spring apparatus 1830 for holding the first c-shaped portion 1811 and the second c-shaped portion 1821 in a stack gripping position. The spring apparatus 1830 can be either a physical spring or can be a band of elastomeric material. In another embodiment, the elastomeric material can wrap all the way around the outer perimeter of the first c-shaped portion 1811 and the second should c-shaped portion 1821. In another embodiment, the elastomeric material may wrap only part way around the two c-shaped members, 1811, 1821. The stack gripper 1810 has a stack gripping position and a stack release position. When in a stack release position, the spring 1830 biases the stack gripper toward the stack gripping position. The stack gripping position is the default or resting position.

Figure 20:
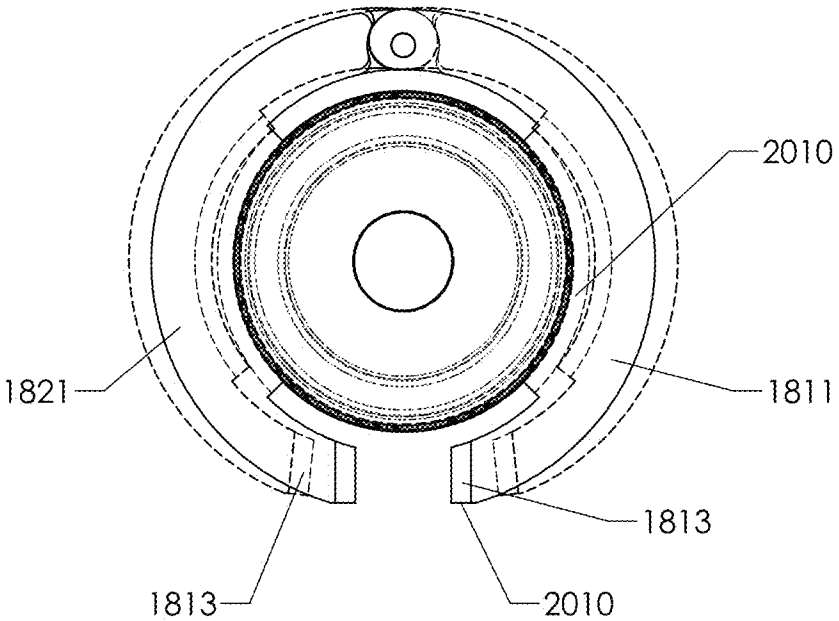
FIG. 20 is a bottom view of the stack gripping and release mechanism 1800, according to an example embodiment.

FIG. 20 is a bottom view of the stack gripping and release mechanism 1800, according to an example embodiment. The spring apparatus is not shown in this view. A lid 2000 is shown in this view. The lid has an exterior surface 2010 and an interior surface 2012. It should be noted that the fingers engage the lid on the interior surface and that the first c-shaped portion 1811, and the second c-shaped portion 1821 grip the exterior surface 2010 of the lid. The first c-shaped portion includes a bevel 1813 and the second c-shaped portion includes a bevel 1823. A wedge, discussed below, interacts with the bevels 1813, 1823 to move first c-shaped portion 1811, and the second c-shaped portion 1821 to a release position which is disengaged from the stack of lids. The release position is shown by dotted lines as 1815 and 1825. The wedge causes the first c-shaped portion 1811 to move away from the second c-shaped portion 1821. The c-shaped portions pivot about a pivot 1822.

The shuttle 1520 includes a wedge 1840 which is attached to a surface of the shuttle 1520 so that it interacts with the c-shaped portions 1811, 1821. A free end 1812 of the first c-shaped portion 1811 and a free end 1822 of the second c-shaped portion 1821 include a bevel 1813, 1823, respectively. The wedge 1840 of the apparatus for picking engages the free end 1812 of the first c-shaped portion 1811 and the free end 1822 of the second c-shaped portion 1821 to move the stack gripper 1810 between a gripping position and a stack release position. The wedge 1840 is sized so that it moves toward or into the beveled edge 1813 of the free end of the first c-shaped portion 1811 and the beveled edge 1823 of the free end 1822 of the second c-shaped portion 1821, it forces the gripper 1810 to a lid release position. The wedge 1840 engages and disengages the stack gripper 1810 through a single cycle. In operation, the stack is gripped by the stack gripper 1810. The fingers engage the inner adage or inner radius of the bottom lid of the stack. At about the same time or maybe a little after initial engagement, the wedge 1840 is moved into the beveled edges 1813, 1823 of the first and second see shaped portions 1811, 1821. This forces the gripper to a release position. The entire stack drops as the lowermost lid is removed and the wedge is removed from its position between the two c-shaped portions so that it once again grips the stack of lids.

Figure 21:
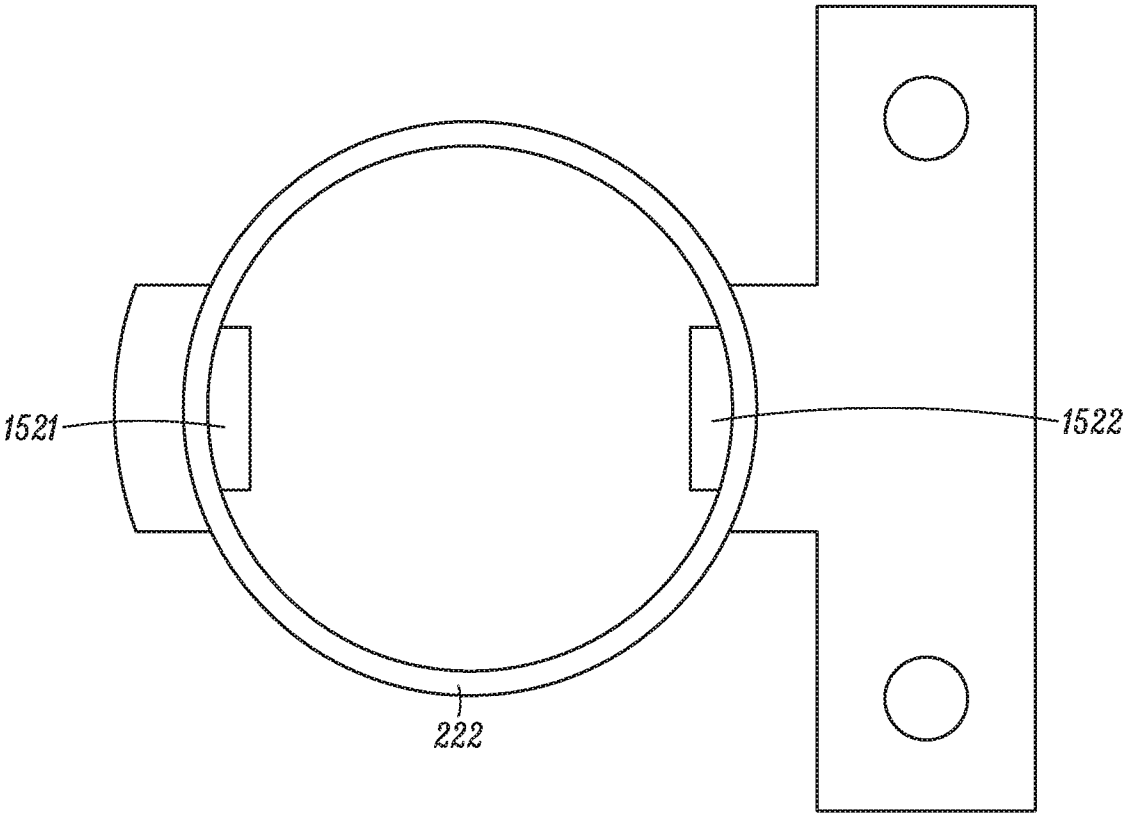
FIG. 21 is a schematic top view of a lid engaged by the mechanism shown in FIG. 15 for removing a lid from a stack of lids, according to an example embodiment of the invention.

FIG. 21 is a schematic top view of a lid 222 engaged by the mechanism 1520 shown in FIG. 15 for removing a lid from a stack of lids, according to an example embodiment of the invention. The mechanism 1520 includes a pair of fingers 1521, 1522 that move into and out of engagement with the bottom lid 222 in a stack of lids to remove a lid from the stack. In FIG. 20, the fingers 1521, 1522 are shown in engagement with the inner diameter of the lid 222. The fingers are spaced approximately equal to the inner diameter of the lid 222.

Figure 19:
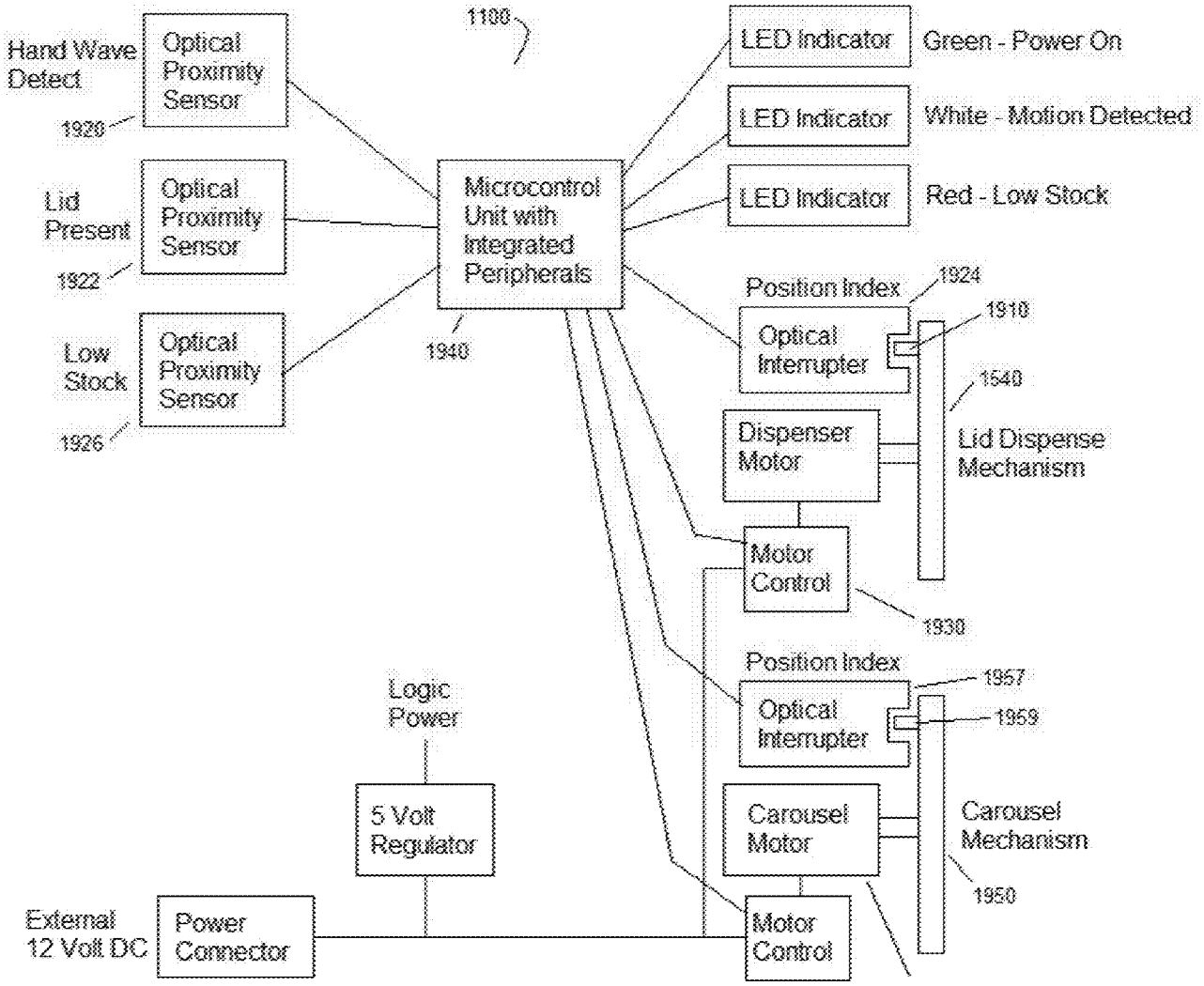
FIG. 19 is an electrical schematic diagram of the lid dispensing system, according to an example embodiment.

FIG. 19 is an electrical schematic diagram of the lid dispensing system 1100, according to an example embodiment. The lid dispensing system 1100 includes an object sensor 1920, a hopper empty sensor 1922, and a flag detection sensor 1924. The object sensor 1920 determines when an object, such as a hand of someone wanting a lid, is near the object sensor 1920. When an object is detected it sends a signal to a microprocessor 1940. In this particular example embodiment, the object detected is a hand and the sensor detects a hand wave or the like. The microprocessor 1940 will send a signal to the rotary actuator 1510 (shown in FIG. 15) or other actuator to start a cycle to dispense a lid or other object. According to the example embodiment shown, the rotary actuator includes an arm which rotates substantially through 360°. This rotation corresponds to a complete cycle. Added to the end of the arm is a flag 1910. The flag is detected by the flag detection sensor 1924. As shown in the FIG. 19, the sensor is an optical interrupter. The flag 1910 interrupts an optical beam or the like. In response, the microprocessor 1940 or a motor controller disables power to halt the rotation or movement of the actuator 1540. The signals or power for rotating the rotary actuator 1540 is disabled in response to the flag 1510 being sensed. The rotary actuator 1540 includes a dispenser motor 1541. Signals or the power needed to commute or rotate the motor 1541 are turned off or otherwise prevented. This ends the cycle for dispensing an object, such as a lid. The cycle is started again in response to an input from the object sensor 1920. As mentioned above there is also a hopper sensor 1922. The hopper sensor 1922 detects when the hopper 1130 is empty. In response to an empty hopper 1130, a signal may be sent to an operator to add a stack of lids to the hopper 1130. Another sensor 1926 detects when the number of lids in the hopper are low. This is advantageous as when the stack is low, an operator can be signaled earlier so that the hopper can be restocked before the hopper goes empty or, should it go empty, the lids are on the way such that the amount of time of an interruption (due to a lack of lids) will be less. In another embodiment, the lid dispensing system 1100 includes a carousel 1950 which holds a plurality of hoppers 1130. The carousel includes a carousel motor 1952 and a carousel motor controller 1954 which controls the movement of the carousel 1950. The carousel 1950 also includes an optical interrupter 1957 which disables movement of the carousel 1950 when a flag 1959 is detected. In one embodiment, a flag 1959 is positioned near each hopper. Movement stops so that a new, full, hopper is positioned for dispensing one lid from a stack of lids. It is contemplated that the carousel will have a plurality of flags 1959. In this other example embodiment, the indication of an empty hopper 1130 causes a signal that will place a new hopper associated with the carousel to be moved into place so that the lids at the bottom of the stack in the hopper can be picked and moved from a position on the stack to a dispensed position. FIG. 19 is provided with a box that schematically represents the carousel 1950. It should be noted that a carousel 1950 can be a rotating structure with hoppers positioned at different radial positions or can be a rectangular or square object with aligned hoppers. These are just two examples of the many possible configurations of a carousel.

A lid dispensing system includes a housing, a sensor and a hopper for holding a stack including a plurality of lids. The sensor senses an object outside the housing. Upon determining that there is an object outside the housing, an apparatus for picking a single lid from the stack of lids held by the hopper picks a single lid and dispenses the single lid to a position outside the housing. The lid dispensing system includes a slide having a portion within the housing and another portion outside the housing. The apparatus for picking the single lid places a single lid on a portion of the slide within the housing. The lid slides along the slide to the position outside the housing. In one embodiment, the apparatus for picking a single lid from the stack of lids includes a single actuator. In other words, a single actuator is able to perform the various operations necessary for picking a single the lid from a stack of lids and dispensing it to the area outside the apparatus. In one embodiment, the actuator is a motor. In another embodiment, the actuator is a manually driven device.

The apparatus for picking a single lid from the stack of lids includes an actuator, a cam surface, a shuttle, and a cam follower. The shuttle is operably connected to an actuator. The actuator moves the shuttle with respect to the cam surface. The shuttle also includes a first finger, and a second finger. At least one of the first and second fingers moved to engage an interior surface of the single lid. The cam follower is attached to at least one of the first and second fingers to move at least one of the first and second fingers into and out of engagement with a single lid. The first finger; and the second finger are movable between an engaged position and a disengaged position. The first and second fingers, in one embodiment, engage an interior surface of the single lid. A cam follower is operably attached to the first and second fingers and moves the first and second fingers into and out of engagement with a single lid.

The lid dispensing system includes a stack gripper for gripping a stack of lids. The stack gripper includes a first c-shaped portion, and a second c-shaped portion pivotally attached to the first c-shaped portion. The stack gripper also includes a spring apparatus for holding the first c-shaped portion and the second c-shaped portion in a stack gripping position. The stack gripper has a stack gripping position and a stack release position. When in a stack release position, the spring biases the stack gripper toward the stack gripping position. The stack gripping position is the default or resting position.

The apparatus for picking a single lid from the stack of lids of the lid dispensing system, in some embodiments, includes a wedge. A free end of the first c-shaped portion and a free end of the second c-shaped portion include a bevel. The wedge of the apparatus for picking engages the free end of the first c-shaped portion and the second c-shaped portion to move the stack gripper between a gripping position and a stack release position. The wedge is sized so that it moves toward or into the beveled edges of the free end of the first c-shaped portion and a free end of the second c-shaped portion, it forces the gripper to a lid release position.

The apparatus for picking a single lid from the stack of lids further includes an actuator, a cam having a cam surface and a shuttle. The shuttle is operably connected to the actuator. The shuttle includes a cam follower that interacts with the cam surface as the actuator moves the shuttle with respect to the cam surface. The cam of the apparatus is interchangeable with another cam. The cam follower includes a cam following end, and a first finger end. The first finger for engages and disengages an interior portion of a lid. The first finger end is associated with the shuttle. The shuttle also includes a pivot arm pivotally attached to the shuttle. The pivot arm also includes a first end for engaging a portion of the cam follower, and a second end for engaging a second finger. The first and second fingers engage and disengage an interior portion of a lid. The first and second fingers associated with the shuttle. In one embodiment, the shuttle includes a guide for the cam follower, the pivot arm, and the second finger.

The sensor of the lid dispensing system is capable of sensing a hand proximate the position outside the housing where a lid will be dispensed. The sensor enables the actuator in response to sensing a hand. The sensor produces a signal that enables the actuator. The sensor that senses a hand enables the actuator to cycle, in one example embodiment. The lid dispensing system also includes a flag attached to the actuator, and a cycle end sensor. The cycle end sensor detects the flag. The cycle end sensor sends a signal to the actuator to disable the actuator in response to detecting a flag on the actuator.

In another example embodiment, the lid dispensing system also includes a low or empty hopper sensor. The low or empty hopper sensor generates a signal to notify or indicate that the hopper is getting low or empty. In one embodiment, the lid dispensing system includes a carousel for holding a plurality of hoppers. The carousel moves another hopper into a position for picking a single lid from the stack of lids held by the hopper in response to a signal from the empty hopper sensor. In some example embodiments, the hopper holds different types of lids. The lids can be different sizes or different types. The lid dispensing system can also include an interface for selecting one of the different types of lids to be dispensed. The sensor for sensing an object outside the housing senses a hand and the apparatus for picking a single lid from the stack of lids held by the hopper dispenses the single lid to a position outside the housing without being touched by a human.

A lid dispensing system includes a housing, a hopper and an apparatus for picking a single lid from the stack of lids held by the hopper. The hopper is generally located within the housing. The hopper holds a stack including a plurality of lids. The apparatus for picking a single lid from the stack of lids held by the hopper dispenses the single lid to a position outside the housing. The apparatus for picking also includes an actuator, a cam surface, a shuttle operably connected to an actuator, the actuator moving the shuttle with respect to the cam surface. The shuttle includes a first finger and a second finger. The first and second fingers are movable between an engaged position and a disengaged position. The first and second fingers engage an interior surface of the single lid. A cam follower operably attached to the first and second fingers moves the first and second fingers into and out of engagement with a single lid. In one embodiment, the actuator is moved manually. In another, the actuator includes a motor.

A lid dispensing method includes placing a stack including a plurality of lids in a hopper, separating a single lid from a stack of lids by engaging an inner surface of a single lid, placing the single lid onto a tray, and conveying the single lid to a position remote from the stack that includes the plurality of lids. The method also includes sensing a hand outside a housing, and starting the separation of the single lid from the stack of lids in response to sensing the hand outside the housing. The single lid is conveyed to a position outside the housing proximate the sensed hand.

Although a few variations have been described and illustrated in detail above, it should be understood that other modifications are possible. In addition it should be understood that the logic flow depicted in the accompanying Figures and described herein do not require the particular order shown, or sequential order, to achieve desirable results. Other embodiments may be within the scope of the following claims.

The foregoing discussion discloses and describes merely exemplary embodiments of the present inventions. Upon review of the specification, one skilled in the art will readily recognize from such discussion, and from the accompanying Figs. and claims, that various changes, modifications and variations can be made therein without departing from the spirit and scope of the invention as defined in the following claims.

The invention claimed is:

1. A lid dispensing system comprising:

a housing;

a sensor for sensing an object outside the housing; and a hopper within the housing, the hopper holding a stack including a plurality of lids; and an apparatus for picking a single lid from the stack of lids held by the hopper and dispensing the single lid to a position outside the housing, wherein the apparatus for picking a single lid from the stack of lids further comprises:

an actuator;

a cam surface;

a shuttle operably connected to an actuator, the actuator moving the shuttle with respect to the cam surface, the shuttle further comprising:

a first finger; and a second finger, at least one of the first and second fingers moved to engage an interior surface of the single lid, the first finger and second finger engaging opposite sides of the interior surface of the single lid, the first finger positioned at a distance from the second finger substantially equal to the inner diameter of the single lid;

a cam follower attached to at least one of the first and second fingers to move at least one of the first and second fingers into and out of engagement with a single lid.

2. The lid dispensing system of claim 1 wherein the apparatus for picking a single lid from the stack of lids held by the hopper and dispensing the single lid to a position outside the housing acts in response to the sensor sensing an object outside the housing.

3. The lid dispensing system of claim 1 wherein the single lid is delivered without touching the lid dispensing system.

4. The lid dispensing system of claim 1 wherein the lid dispensing system is touchless so the single lid is delivered without touching the lid dispensing system.

5. The lid dispensing system of claim 1 wherein the lid dispensing system is touchless so the single lid is delivered to a position outside the housing without touching the lid dispensing system.

6. The lid dispensing system of claim 1 further comprising:

a stack gripper for gripping a stack of lids which includes:

a first c-shaped portion; and a second c-shaped portion pivotally attached to the first c-shaped portion, the stack gripper having a stack gripping position and a stack release position; and a spring apparatus for holding the first c-shaped portion and the second c-shaped portion in a stack gripping position.

7. The lid dispensing system of claim 6 wherein the apparatus for picking a single lid from the stack of lids further comprises a wedge and wherein a free end of the first c-shaped portion and a free end of the second c-shaped portion include a bevel, the wedge of the apparatus for picking engaging the free end of the first c-shaped portion and the second c-shaped portion to move the stack gripper between a gripping position and a stack release position.

8. The lid dispensing system of claim 1 wherein the shuttle includes a guide for the cam follower, the pivot arm, and the second finger.

9. A lid dispensing system comprising:

a housing;

a sensor for sensing an object outside the housing; and a hopper within the housing, the hopper holding a stack including a plurality of lids; and an apparatus for picking a single lid from the stack of lids held by the hopper and dispensing the single lid to a position outside the housing, wherein the apparatus for picking a single lid from the stack of lids further comprises:

an actuator;

a cam surface;

a shuttle operably connected to an actuator, the actuator moving the shuttle with respect to the cam surface, the shuttle further comprising:

a first finger; and a second finger, the first and second fingers movable between an engaged position and a disengaged position, the first and second fingers engaging an interior surface of the single lid across the inner diameter of the lid, the first finger engaging a first interior portion, and the second finger engaging a second interior portion of the lid;

a cam follower operably attached to the first and second fingers to move the first and second fingers into and out of engagement with a single lid, wherein the distance between the first finger and the second finger is substantially equal to the inner diameter of the lid at some time when the first finger and second finger travel between the disengaged position and the engaged position.

10. The lid dispensing system of claim 9 wherein the apparatus for picking a single lid from the stack of lids held by the hopper and dispensing the single lid to a position outside the housing acts in response to the sensor sensing an object outside the housing.

11. The lid dispensing system of claim 9 wherein the lid dispensing system is touchless so the single lid is delivered without touching the lid dispensing system.

12. The lid dispensing system of claim 9 wherein the lid dispensing system is touchless so the single lid is delivered to a position outside the housing without touching the lid dispensing system.

13. The lid dispensing system of claim 9 further comprising:

a stack gripper for gripping a stack of lids which includes:

a first c-shaped portion; and a second c-shaped portion pivotally attached to the first c-shaped portion, the stack gripper having a stack gripping position and a stack release position; and a spring apparatus for holding the first c-shaped portion and the second c-shaped portion in a stack gripping position.

14. The lid dispensing system of claim 13 wherein the apparatus for picking a single lid from the stack of lids further comprises a wedge and wherein a free end of the first c-shaped portion and a free end of the second c-shaped portion include a bevel, the wedge of the apparatus for picking engaging the free end of the first c-shaped portion and the second c-shaped portion to move the stack gripper between a gripping position and a stack release position.

15. The lid dispensing system of claim 9 wherein the shuttle includes a guide for the cam follower, the pivot arm, and the second finger.

* * * * *